US010118192B2

(12) United States Patent
Hoover

(10) Patent No.: US 10,118,192 B2
(45) Date of Patent: Nov. 6, 2018

(54) CAULKING CANNON

(71) Applicant: Rodney Hoover, New Philadelphia, OH (US)

(72) Inventor: Rodney Hoover, New Philadelphia, OH (US)

( * ) Notice: Subject to any disclaimer, the term of this patent is extended or adjusted under 35 U.S.C. 154(b) by 0 days.

(21) Appl. No.: 14/825,791

(22) Filed: Aug. 13, 2015

(65) Prior Publication Data

US 2016/0045930 A1 Feb. 18, 2016

Related U.S. Application Data

(60) Provisional application No. 62/036,897, filed on Aug. 13, 2014.

(51) Int. Cl.
*B05C 17/01* (2006.01)
*B05C 17/005* (2006.01)

(52) U.S. Cl.
CPC .... *B05C 17/0103* (2013.01); *B05C 17/00553* (2013.01); *B05C 17/00583* (2013.01); *B05C 17/00596* (2013.01)

(58) Field of Classification Search
CPC ..... B05C 17/00553; B05C 17/00596; B05C 17/0103; B05C 17/00583
See application file for complete search history.

(56) References Cited

U.S. PATENT DOCUMENTS 3,401,847 A * 9/1968 Downing ..... B05C 17/0123 222/327
4,180,187 A * 12/1979 Ben-Haim ..... B05C 17/0103 192/141
4,376,498 A * 3/1983 Davis, Jr. ..... B05C 17/015 222/326
5,046,642 A * 9/1991 Cathcart, Sr. ..... B05C 17/0103 222/153.09
5,188,259 A * 2/1993 Petit ..... B05C 17/002 222/146.5
5,246,144 A * 9/1993 Cathcart, Sr. ..... B05C 17/0103 222/153.13
5,361,946 A * 11/1994 Ginther ..... A23G 3/0242 222/175

(Continued)

*Primary Examiner* — Frederick C Nicolas
*Assistant Examiner* — Bob Zadeh
(74) *Attorney, Agent, or Firm* — Black, McCuskey, Souers & Arbaugh, LPA

(57) ABSTRACT

A caulking cannon having a motorized plunger-moving component configured to drive a plunger shaft along an axis that is substantially parallel to a caulking-cannon longitudinal axis; a cartridge-holding barrel component coupled to the motorized plunger-moving component; a handle coupled to the cartridge-holding barrel component; a caulk exit-port component coupled to the cartridge-holding barrel component; wherein the plunger shaft is configured to move in a first direction parallel to a caulking-cannon longitudinal axis and thereby enter into a volume of space within the cartridge-holding barrel component; wherein the cartridge-holding barrel component is configured to hold a caulk cartridge having a fluid-chamber volume of at least three-fourths of a gallon; wherein the motorized plunger-moving component has a hand grip; and wherein the caulk exit-port component is configured to channel caulk fluid flow from the caulk cartridge to an exit orifice.

9 Claims, 21 Drawing Sheets

(56) References Cited

U.S. PATENT DOCUMENTS

| | | | | |
|---|---|---|---|---|
| 5,775,539 | A * | 7/1998 | Bates | B05C 17/0103 222/1 |
| 8,240,520 | B2 * | 8/2012 | Scheid | F42D 1/10 222/1 |
| 2006/0043120 | A1 * | 3/2006 | Campbell | B05C 17/0146 222/386.5 |
| 2009/0065527 | A1 * | 3/2009 | Buck | B05C 17/00576 222/95 |
| 2009/0272767 | A1 * | 11/2009 | Herman | G01F 11/026 222/326 |
| 2011/0056996 | A1 * | 3/2011 | Schneider | B05C 17/0103 222/333 |
| 2016/0045930 | A1 * | 2/2016 | Hoover | B05C 17/0103 222/136 |

* cited by examiner

CAULKING CANNON

CROSS REFERENCE TO RELATED APPLICATIONS

This non-provisional patent application claims priority to provisional patent application Ser. No. 62/036,897 filed on Aug. 13, 2014. The subject matter of provisional patent application Ser. No. 62/036,897 is hereby incorporated by reference.

BACKGROUND OF THE INVENTION

Caulking guns are known to dispense caulk or other adhesive materials such as: silicone-based material, latex-based material, acrylic latex silicone blend material, elastomeric material, polyurethane material, concrete material, blacktop repair material, and concrete repair material. Traditional caulking guns typically dispense less than twenty ounces of caulk before needing to replace the caulk cartridge or caulk sausage. Frequently replacing caulk cartridges or caulk sausages because of limited cartridge or sausage caulk-volume capacities causes downtime inefficiencies.

BRIEF SUMMARY OF THE INVENTION

A caulking cannon having a motorized plunger-moving component configured to drive a plunger shaft along an axis that is substantially parallel to a caulking-cannon longitudinal axis; a cartridge-holding barrel component coupled to the motorized plunger-moving component; a handle coupled to the cartridge-holding barrel component; a caulk exit-port component coupled to the cartridge-holding barrel component; wherein the plunger shaft is configured to move in a first direction parallel to a caulking-cannon longitudinal axis and thereby enter into a volume of space within the cartridge-holding barrel component; wherein the cartridge-holding barrel component is configured to hold a caulk cartridge having a fluid-chamber volume of at least three-fourths of a gallon; wherein the motorized plunger-moving component has a hand grip; and wherein the caulk exit-port component is configured to channel caulk fluid flow from the caulk cartridge to an exit orifice.

A caulking cannon having a motorized plunger-moving component configured to drive a plunger shaft along an axis that is substantially parallel to a caulking-cannon longitudinal axis; a cartridge-holding barrel component coupled to the motorized plunger-moving component; a handle coupled to the cartridge-holding barrel component; a caulk exit-port component coupled to the cartridge-holding barrel component; wherein the plunger shaft is configured to move in a first direction parallel to a caulking-cannon longitudinal axis and thereby enter into a volume of space within the cartridge-holding barrel component; wherein the cartridge-holding barrel component is configured to hold a caulk cartridge that is a sausage-barrel assembly; wherein the motorized plunger-moving component has a hand grip; and wherein the caulk exit-port component is configured to channel caulk fluid flow from the caulk cartridge to an exit orifice.

A multiple-tube caulking gun having a plurality of substantially parallel plunger shafts; a motorized plunger-moving component configured to drive a single plunger shaft and thereby cause a plurality of substantially parallel plunger shafts to move in a first direction; a multiple-tube barrel component coupled to the motorized plunger-moving component; a caulk exit-port component coupled to the multiple-tube barrel component; wherein the multiple-tube barrel component has a plurality of caulk-holding tubes that are each configured to hold a caulking sausage, wherein the number of caulk-holding tubes is equal to the number of plunger shafts, wherein the plunger shafts and caulk-holding tubes are aligned substantially parallel to a multiple-tube caulking-gun longitudinal axis, wherein each plunger shaft is independently configured to be driven in the first direction and into a different caulk-holding tube, and wherein the caulk exit-port component is configured to channel caulk fluid flow from the plurality of caulk-holding tubes to an exit orifice.

DETAILED DESCRIPTION OF THE INVENTION

Embodiments are directed to caulk-dispensing apparatuses. A first embodiment is directed to a caulking cannon, and a second embodiment is directed to a multiple-tube caulking gun.

Figure 1:
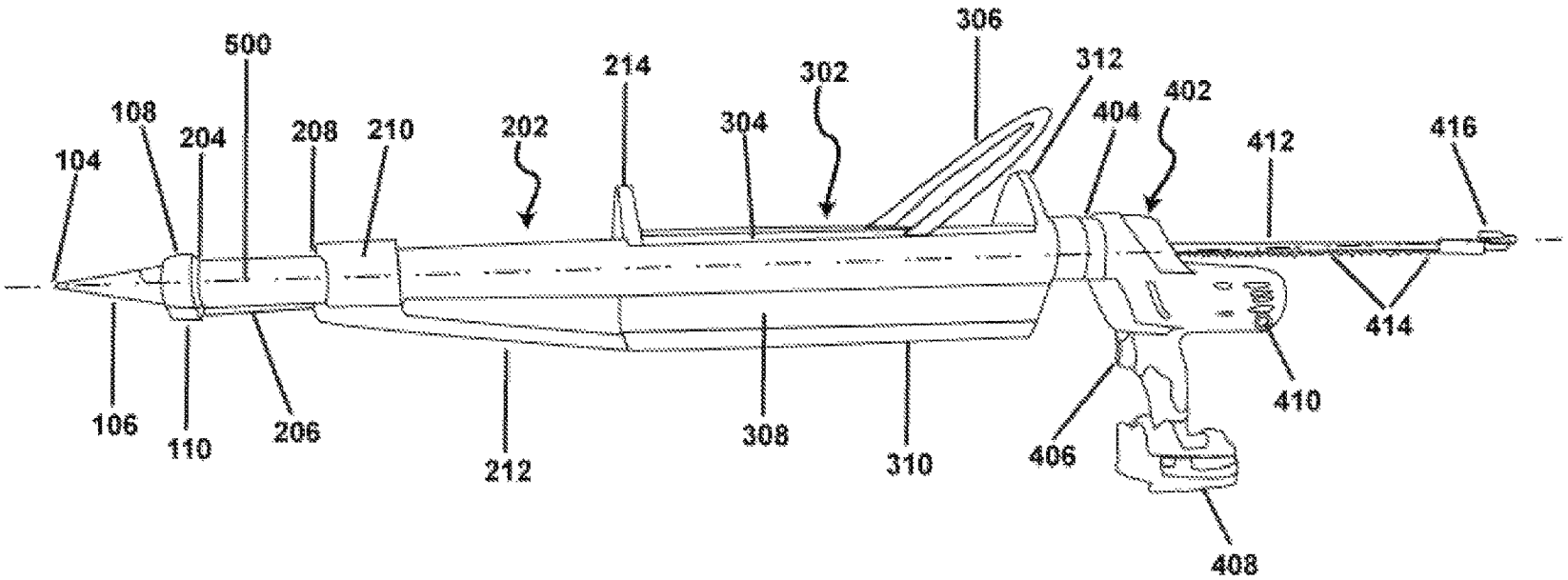
FIG. 1 is a caulking-cannon side view.

With reference to the figures, FIG. 1 shows a caulking-cannon embodiment side view. The caulking-canon embodiment has three main components: motorized plunger-moving component 402, cartridge-holding barrel component 302, and caulk exit-port component 202.

Motorized plunger-moving component 402 is shown as having the following subcomponents: plunger handle 416, plunger teeth 414, plunger shaft 412, speed dial 410, battery 408, handle grip 406, and female threaded coupler 404. More specifically, plunger handle 416 is on the end of and attached to plunger shaft 412 that has plunger teeth 414 disposed on a first side and along the longitudinal length of plunger shaft 412. Motorized plunger-moving component 402 has at least one motorized gear configuration (not shown) that is configured to engage plunger teeth 414 and thereby drive plunger shaft 412 in both longitudinal directions along caulk-cannon longitudinal axis 500. Motorized plunger-moving component 402 is powered by battery 408 and turned on and off using a trigger on handle grip 416; speed dial 410 allows for variable speed control of the at least one motorized gear configuration (not shown). Female threaded coupler 404 enables coupling of motorized plunger-moving component 402 to cartridge-holding barrel component 302.

Cartridge-holding barrel component 302 is shown as having the following subcomponents: cartridge-holding barrel-component rear wall 312, handle 306, barrel-component side 304, cartridge-holding barrel-component front wall 214, barrel-component bottom 310, and barrel-component wall 308. More specifically, cartridge-holding barrel-component rear wall 312 and cartridge-holding barrel-component front wall 214 define both 1) the longitudinal length of cartridge-holding barrel component 302, and 2) the longitudinal length of a useful caulk cartridge that may be inserted into cartridge-holding barrel component 302. Handle 306 provides a user with a second hand placement for holding the caulking cannon (the first hand placement being handgrip 406); handle 306 is a load bearing handle that enables a user to support the weight of the caulking cannon during operation. In an embodiment, handle 306 has a load capacity of at least 15 pounds; in another embodiment, handle 306 has a load capacity of at least 20 pounds; and in another embodiment, handle 306 has a load capacity of at least 25 pounds. In another embodiment, handle 306 is oriented at an angle ranging from about 30 to about 90 degrees relative to caulk-canon longitudinal axis 500. Barrel-component wall 308 defines an internal volume of space within cartridge-holding barrel component 302 into which caulk cartridge 2300 may be inserted. In an embodiment, caulk cartridge 2300 has a fluid-chamber volume of at least three-fourths (¾) of a gallon. In another embodiment, caulk cartridge 2300 is an enclosed volume that is substantially cylindrical and has at least one removable end. In still another embodiment, caulk cartridge 2300 is a sausage-barrel assembly as shown in FIG. 23, and any useful volume of caulk sausages may be employed. In still another embodiment, caulk cartridge 2300 is a bucket with orifices at its top and bottom.

Caulk exit-port component 202 is shown as having the following subcomponents: exit-port neck 210, junction of exit-port neck and exit-port tube 208, exit-port-tube threads 204, threaded collar 108, exit orifice 104, support arm 212, exit-port tube 206, threaded-collar ridge 110, and spout 106. More specifically, exit-port tube 206 is relatively positioned along caulk-cannon longitudinal axis 500 and adjacently positioned against cartridge-holding barrel-component front wall 214 thereby enabling caulk fluid flow from caulk cartridge 2300 into and along exit-port tube 206. Support arm 212 is a weight-bearing support structure that assists in supporting the weight of caulk exit-port component 202 and the weight of the caulk fluid flow through exit-port tube 206. Exit-port neck 210 acts as a support and guiding orifice through which exit-port tube 206 passes as it extends along caulk-canon longitudinal axis 500 and away from cartridge-holding barrel component 302. Exit-port-tube threads 204 enable threaded collar 108 to be coupled to an end of exit-port tube 206. Threaded collar 108 couples spout 106 to exit-port tube 206, and thereby enables spout 106 to receive caulk fluid flow from exit-port tube 206. Caulk is dispensed from caulk exit-port component 202 via exit orifice 104.

Figure 2:
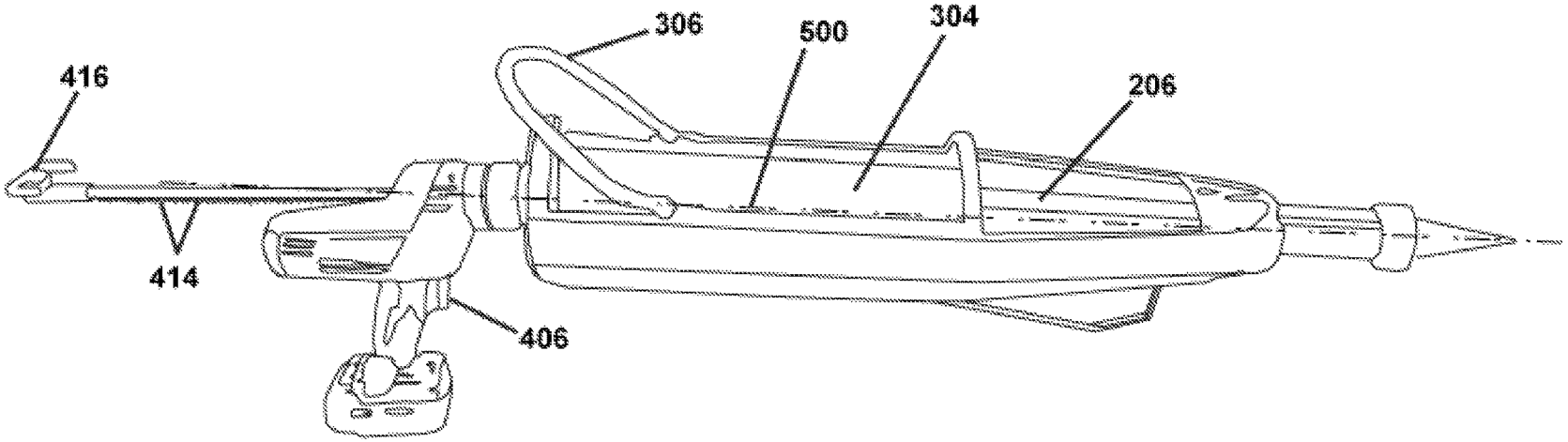
FIG. 2 is a caulking-cannon side-perspective view.

FIG. 2 shows a caulking-cannon embodiment side-perspective view. The relative position and purpose of the numerated mechanical elements are the same as defined above.

Figure 3:
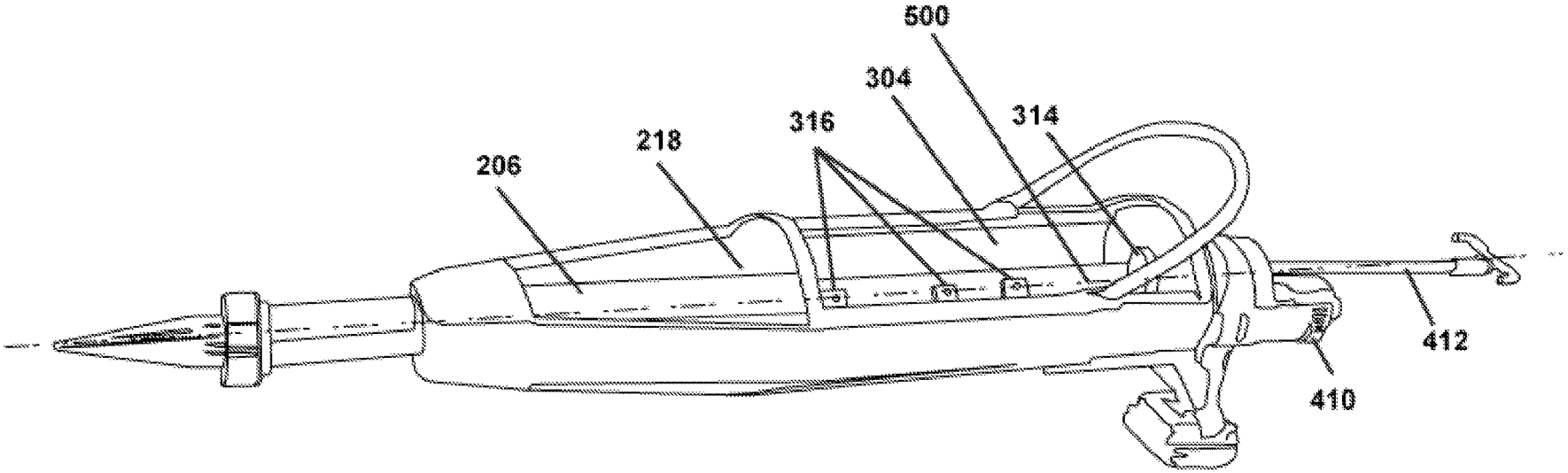
FIG. 3 is a caulking-cannon side-perspective view.

FIG. 3 shows a caulking-cannon embodiment side-perspective view. Additional mechanical elements shown in this view are side-support arm 218 and cartridge-supporting nodules 316 upon which caulk cartridge 2300 rests when positioned within cartridge-holding barrel component 302. Circular plunger end piece 314 is shown as being positioned on the end of plunger shaft 412, and as circular plunger end piece 314 is driven and enters into a volume of space within cartridge-holding barrel component 302, circular plunger end piece 314 presses against and applies pressure to an end of caulk cartridge 2300 (not shown). As circular plunger end piece 314 enters further into the volume of space within cartridge-holding barrel component 302, and therefore applies additional pressure to an end of caulk cartridge 2300 (not shown), the volume of space within caulk cartridge 2300 (not shown) is reduced and therefore forces caulk to flow out of caulk cartridge 2300 (not shown) and into exit-port tube 206.

Figure 4:
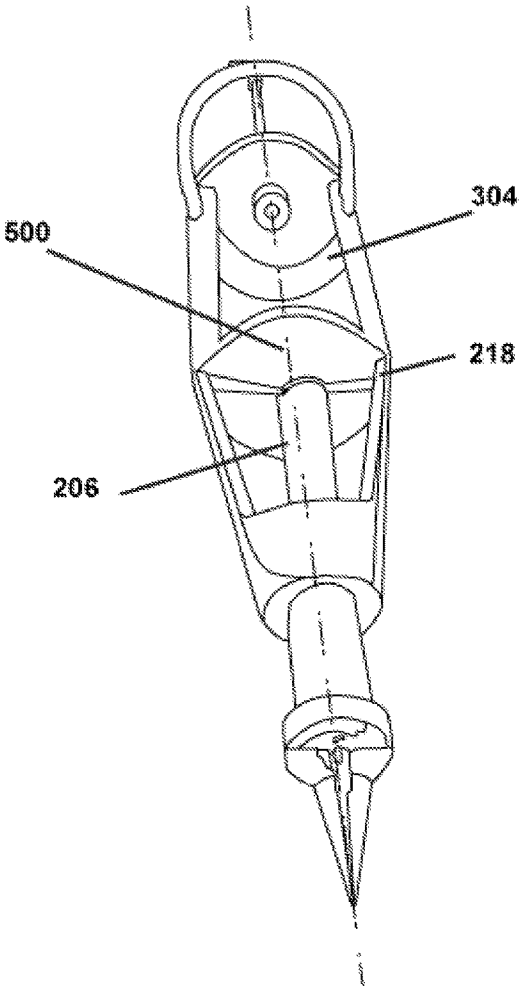
FIG. 4 is a caulking-cannon top-perspective view.

FIG. 4 shows a caulking-cannon embodiment top-perspective view. The relative position and purpose of the numerated mechanical elements are the same as defined above.

Figure 5:
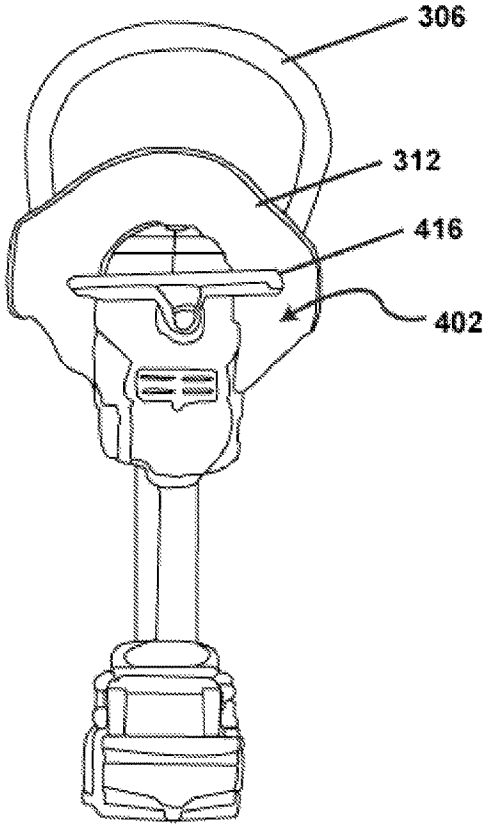
FIG. 5 is a caulking-cannon rear view.

FIG. 5 shows a caulking-cannon embodiment rear view. The relative position and purpose of the numerated mechanical elements are the same as defined above.

Figure 6:
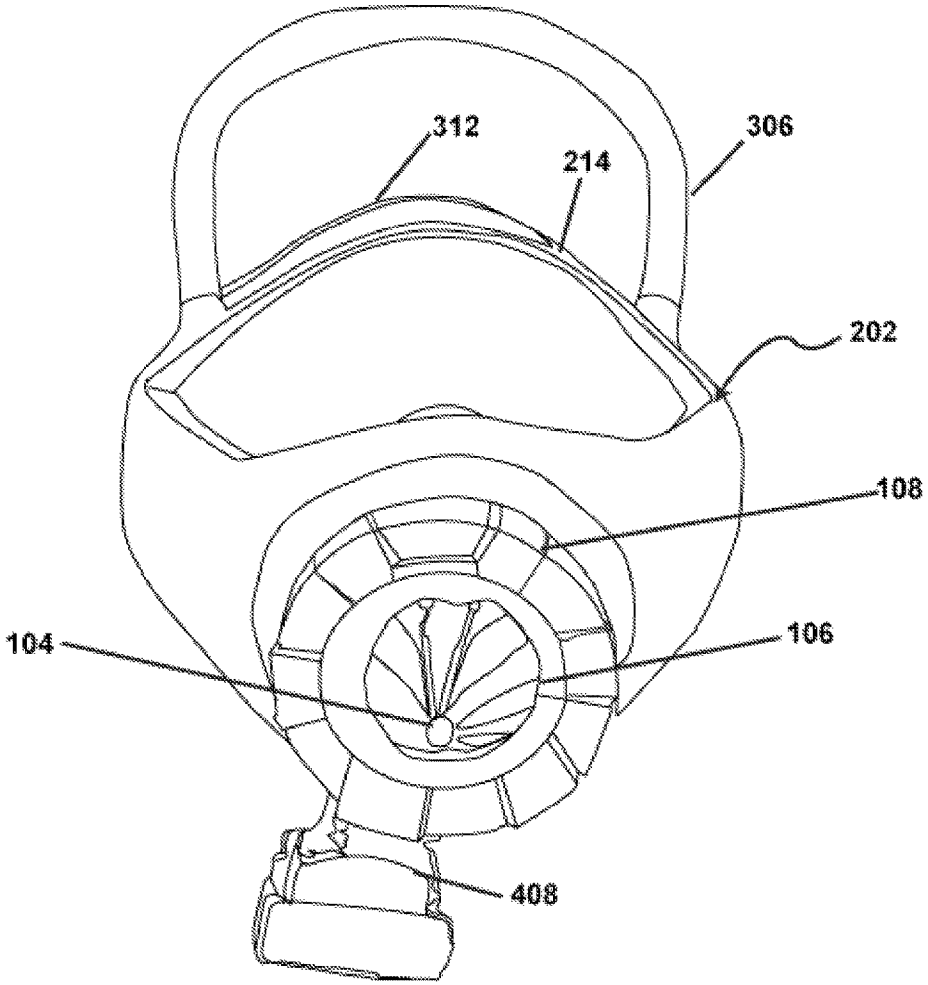
FIG. 6 is a caulking-cannon front view.

FIG. 6 shows a caulking-cannon embodiment front view. The relative position and purpose of the numerated mechanical elements are the same as defined above.

Figure 7:
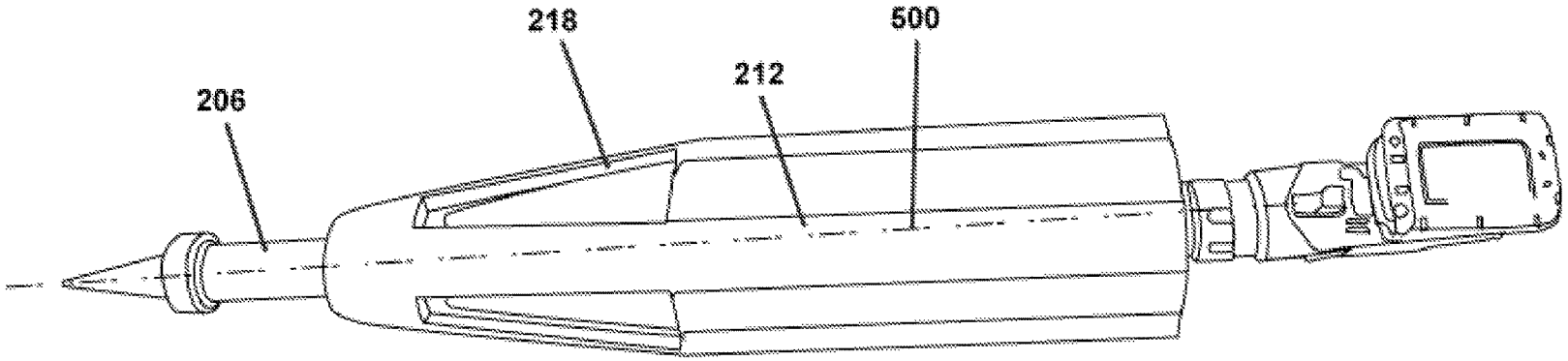
FIG. 7 is a caulking-cannon bottom view.

FIG. 7 shows a caulking-cannon embodiment bottom view. The relative position and purpose of the numerated mechanical elements are the same as defined above.

Figure 8:
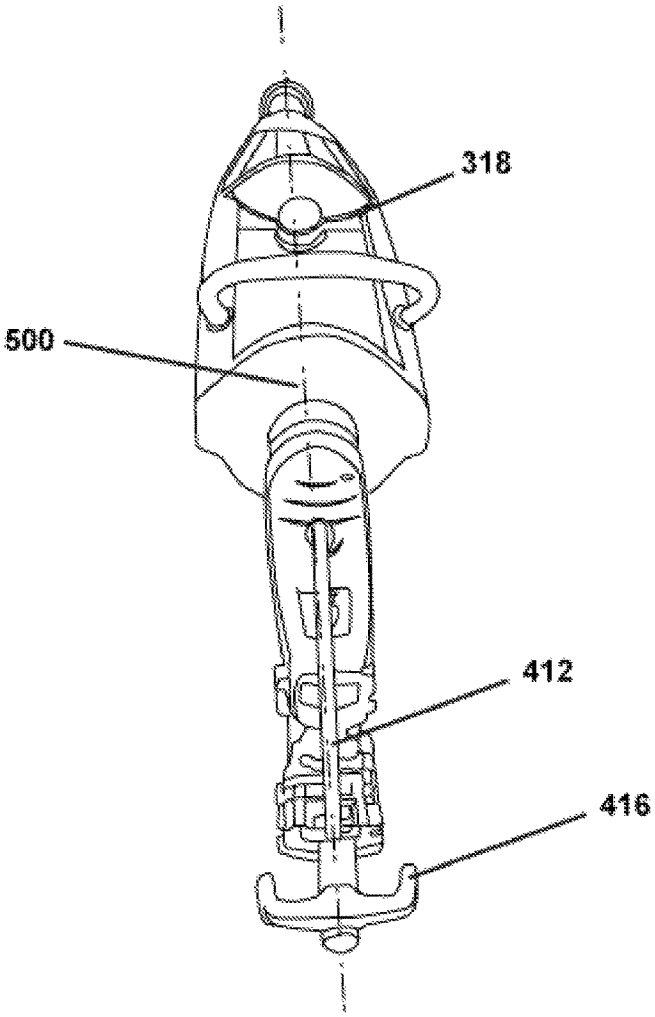
FIG. 8 is a caulking-cannon top-perspective view.

FIG. 8 shows a caulking-cannon embodiment rear-perspective view. An additional mechanical element shown in this view is exit-port tube orifice 318. Exit-port tube orifice 318 functions as the orifice through which caulk fluid flow from caulk cartridge 2300 travels into exit-port tube 206 (not shown). Additionally, the relative position and purpose of the other numerated mechanical elements are the same as defined above.

Figure 9:
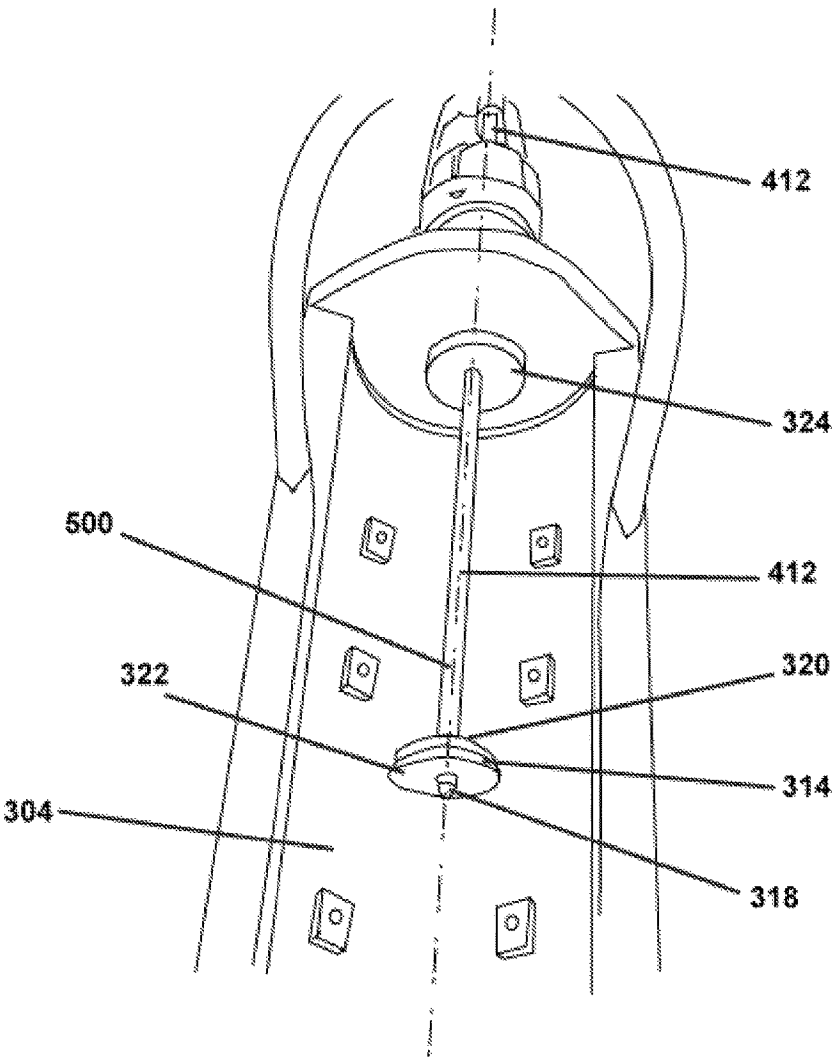
FIG. 9 is a caulking-cannon top-perspective view.

FIG. 9 shows an enlarged caulking-cannon embodiment top-perspective view. Plunger shaft 412 is shown as protruding through cartridge-holding barrel-component rear-wall orifice 324 and extending along caulk-cannon longitudinal axis 500 into a volume of space within cartridge-holding barrel component 302. The volume of space within cartridge-holding barrel component 302 being at least partially defined by barrel-component side 304. Circular plunger end piece 314 is shown as being attached to the end of plunger shaft 412 by plunger end nut 318. Both rear and front portions of circular plunger end piece 314 are respectively shown as 320 and 322.

Figure 10:
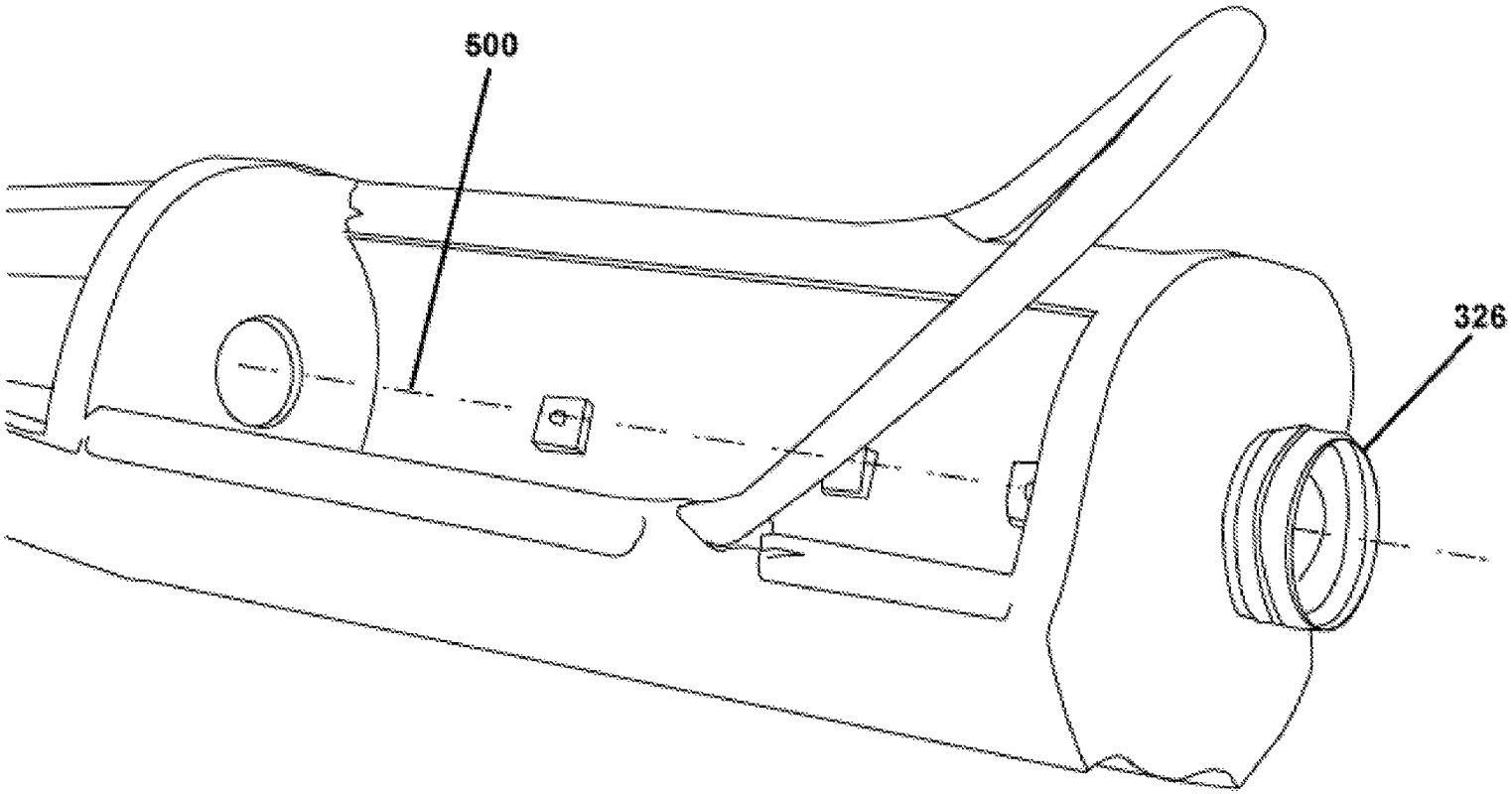
FIG. 10 is a caulking-cannon side-perspective view.

FIG. 10 shows an enlarged caulking-cannon embodiment side-perspective view. Caulk-canon longitudinal axis 500 is shown as passing through cartridge-holding barrel component 302 and male threaded circular flange component 326.

Figure 11:
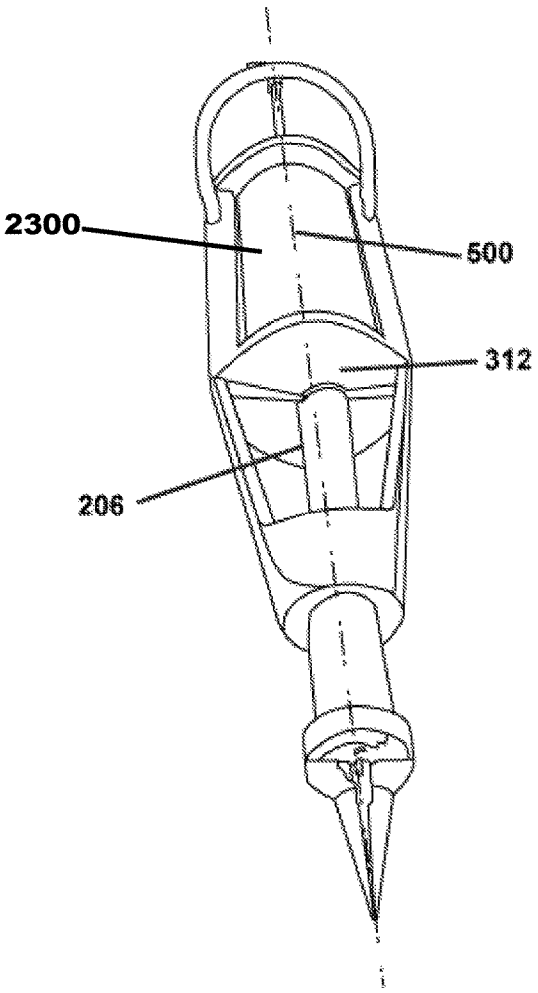
FIG. 11 is a caulking-cannon top-perspective view.

FIG. 11 shows a caulking-cannon embodiment top-perspective view. This view and embodiment shows caulking cartridge 2300 positioned within cartridge-holding barrel component 302. The relative position and purpose of the numerated mechanical elements are the same as defined above.

In an embodiment, the longitudinal length of the caulking cannon, not including the length of plunger shaft 412, is at least 42 inches. In another embodiment, the longitudinal length of the caulking cannon, not including the length of plunger shaft 412, ranges from 42 inches to 60 inches.

Figure 12:
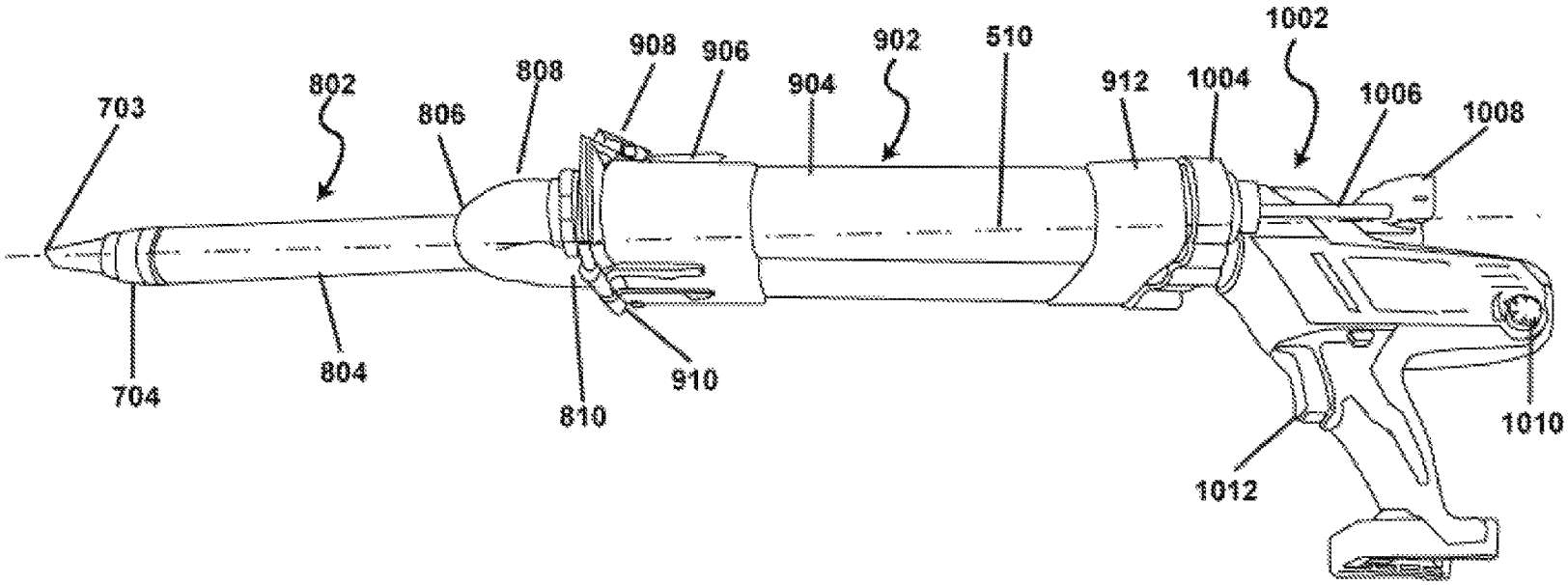
FIG. 12 is a multiple-tube caulking-gun side view.

FIG. 12 shows a multiple-tube caulking-gun side view. The multiple-tube caulking-gun embodiment has three main components: motorized plunger-moving component 1002, multiple-tube barrel component 902, and caulk exit-port component 802.

Motorized plunger-moving component 1002 is shown as having the following subcomponents: plunger handle 1008, outer plunger shaft 1006, female threaded coupler 1004, handle grip 1012, and speed dial 1010. More specifically, plunger handle 1008 is on the end of and attached to outer plunger shaft 1006 and/or central plunger shaft 1007 (not shown) that have plunger teeth (not shown) disposed on a first side and along the longitudinal length of plunger shaft 1006 and/or central plunger shaft 1007 (not shown). Motorized plunger-moving component 1006 has at least one motorized gear configuration (not shown) that is configured to engage central plunger-shaft teeth (not shown) and thereby drive all three plunger shafts that include both outer plunger shafts 1006 as well as central plunger shaft 1007 (not shown) in both longitudinal directions parallel to multiple-tube caulking-gun longitudinal axis 510. In an embodiment, the ends of all three plunger shafts are fixedly connected to plunger handle 1008, and central plunger shaft 1007 is the only drive shaft driven by motorized plunger-moving component 1002. Therefore in an embodiment, when central plunger shaft 1007 is driven by motorized plunger-moving component 1002, both outer plunger shafts 1006 are also moved at the same rate. Motorized plunger-moving component 1002 is battery powered and turned on and off using a trigger on handle grip 1012; speed dial 1010 allows for variable speed control of the at least one motorized gear configuration (not shown). Female threaded coupler 1004 enables coupling of motorized plunger-moving component 1002 to multiple-tube barrel component 902.

Multiple-tube barrel component 902 is shown as having the following subcomponents: rear stabilizer band 912, caulk-holding tube 904, front stabilizer band 906, clamp 908, and hinge 910. More specifically, rear stabilizer band 912 and front stabilizer band 906 secure the plurality of caulk-holding tubes 904 in position within multiple tube barrel component 902. In embodiments, caulk holding tube(s) 904 is configured to receive caulk cartridges and caulk sausages. Three caulk-holding tubes 904 are shown in FIG. 12. For each caulk-holding tube 904, a female threaded coupler 1004 is secured to male threaded circular flange component (not shown) located on the end of each caulk-holding tube 904. In an embodiment, each caulk-holding tube 904 has an internal volume of at least 10 fluid ounces. In another embodiment, each caulk-holding tube 904 has an internal volume of at least 15 fluid ounces. In still another embodiment, each caulk-holding tube 904 has an internal volume of at least 20 fluid ounces. In still another embodiment, each caulk-holding tube 904 has internal volume of at least 25 fluid ounces. Front stabilizer band 906 is hingedly attached to first and second exit-port curved portions 808, 810 by hinge 910 and hinge clamp 908.

Caulk exit-port component 802 is shown as having the following subcomponents: transition-flow first curved tube 808, transition-flow second curved tube 810, intersection of three-transition-tubes-and-straight-tube 806, exit-port straight tube 804, threaded collar 704, and exit orifice 703. More specifically, each end of the three caulk-holding tubes 904 are positioned adjacent to and aligned with each of the three corresponding transition tubes that include: transition-flow first curved tube 808, transition-flow second curved tube 810, transition flow central tube 814 (not shown). It is this mechanical alignment that enables caulk fluid flow to travel from each of the three caulk-holding tubes 904 and into each of the three respectively aligned transition tubes that include: transition-flow first curved tube 808, transition-flow second curved tube 810, transition flow central tube 814 (not shown). From each of the three transition tubes, fluid flow is centralized at the intersection of three-transition-tubes-and-straight-tube 806 and then travels into exit-port straight tube 804. Threaded collar 704 couples an end of exit-port straight tube 804 to an end piece that defines exit orifice 703. Caulk is dispensed from exit-port straight tube 804 via exit orifice 703.

Figure 13:
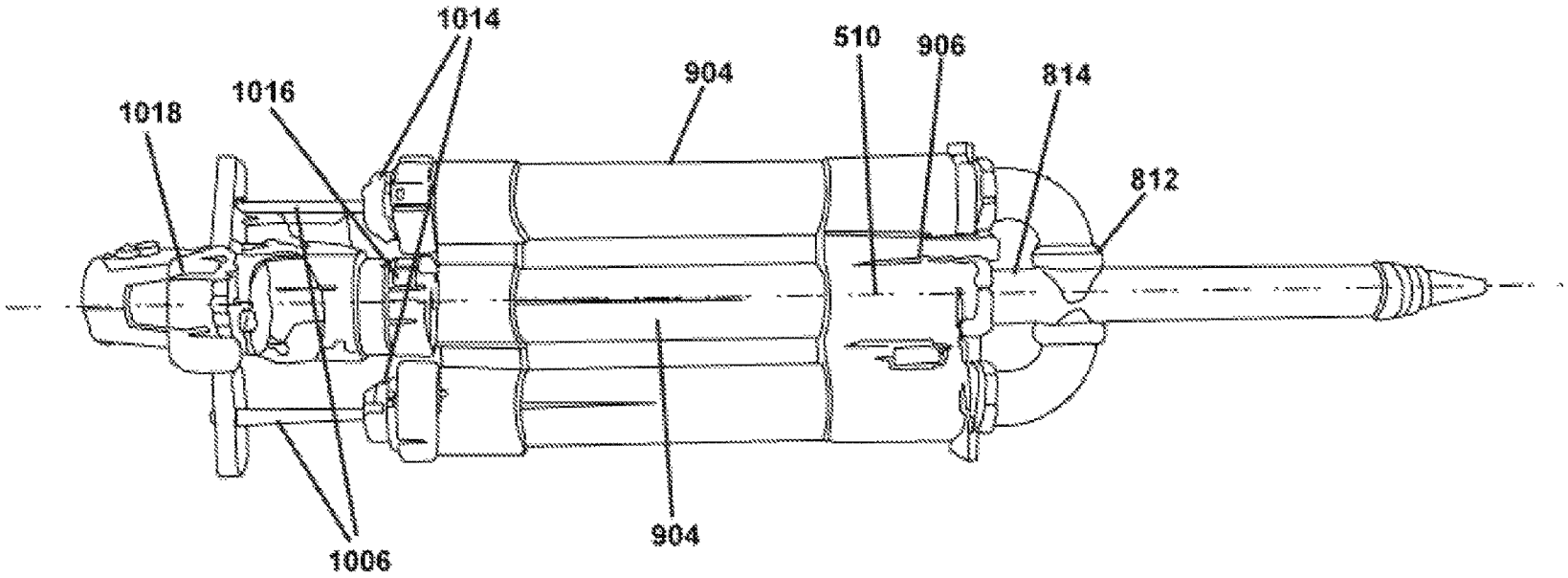
FIG. 13 is a multiple-tube caulking-gun bottom view.

FIG. 13 shows a multiple-tube caulking-gun bottom view. Additional numerated mechanical elements shown in this view include battery 1018 located at the base of handle grip 1012. Flange component 1014 that is fixedly attached to acts as a guiding port through which outer plunger shaft 1006 travels into outer caulk-holding tube 904. From this bottom view, both outer plunging shafts 1006 can be understood as traveling into their respective outer caulk-holding tubes 904 through outer flange components 1014. Transition flow central tube 814 is shown as exiting from the central portion of front stabilizer band 906. Also shown in this view is transition coupler 812 that connects transition-flow first curved tube 808 to the intersection of three-transition-tubes-and-straight-tube 806. In an embodiment, transition coupler 812 is a female threaded coupling component.

Figure 14:
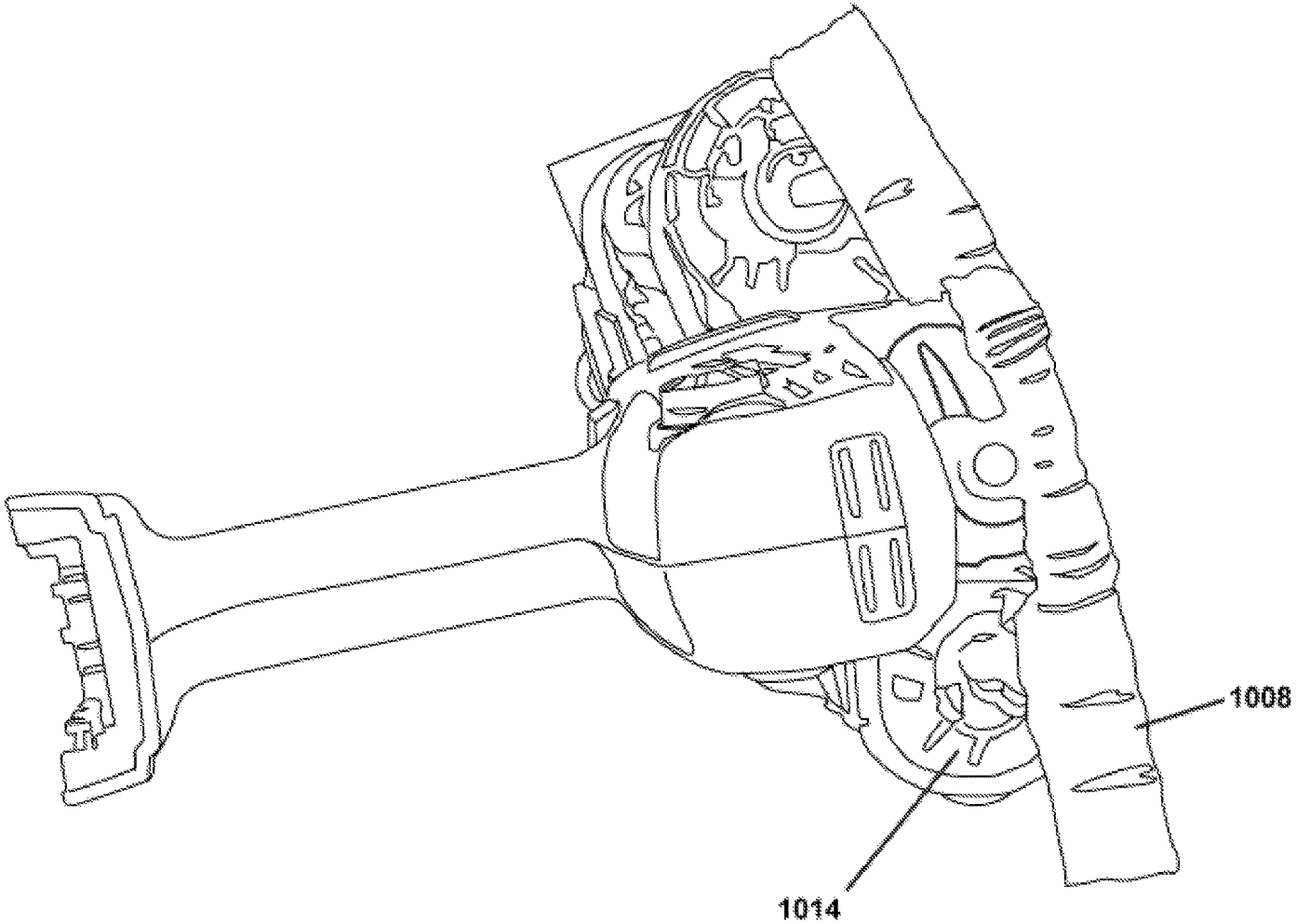
FIG. 14 is a multiple-tube caulking-gun rear view.

FIG. 14 shows a multiple-tube caulking-gun rear view. Outer flange component 1014 and plunger handle 1008 are identified and shown.

Figure 15:
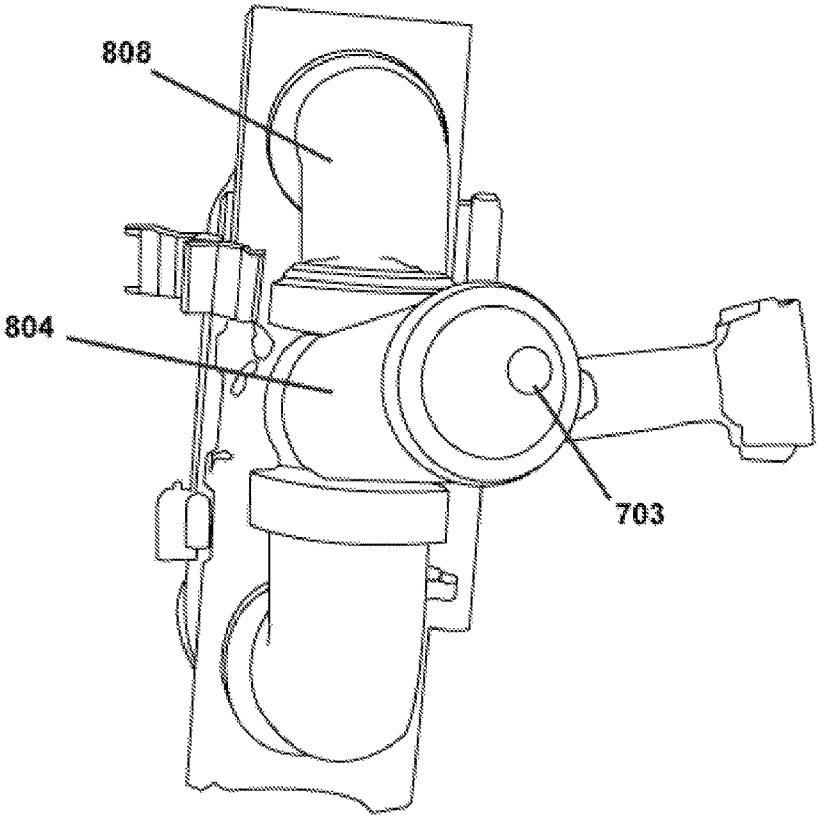
FIG. 15 is a multiple-tube caulking-gun front view.

FIG. 15 shows a multiple-tube caulking-gun front view. The relative position and purpose of the numerated mechanical elements are the same as defined above.

Figure 16:
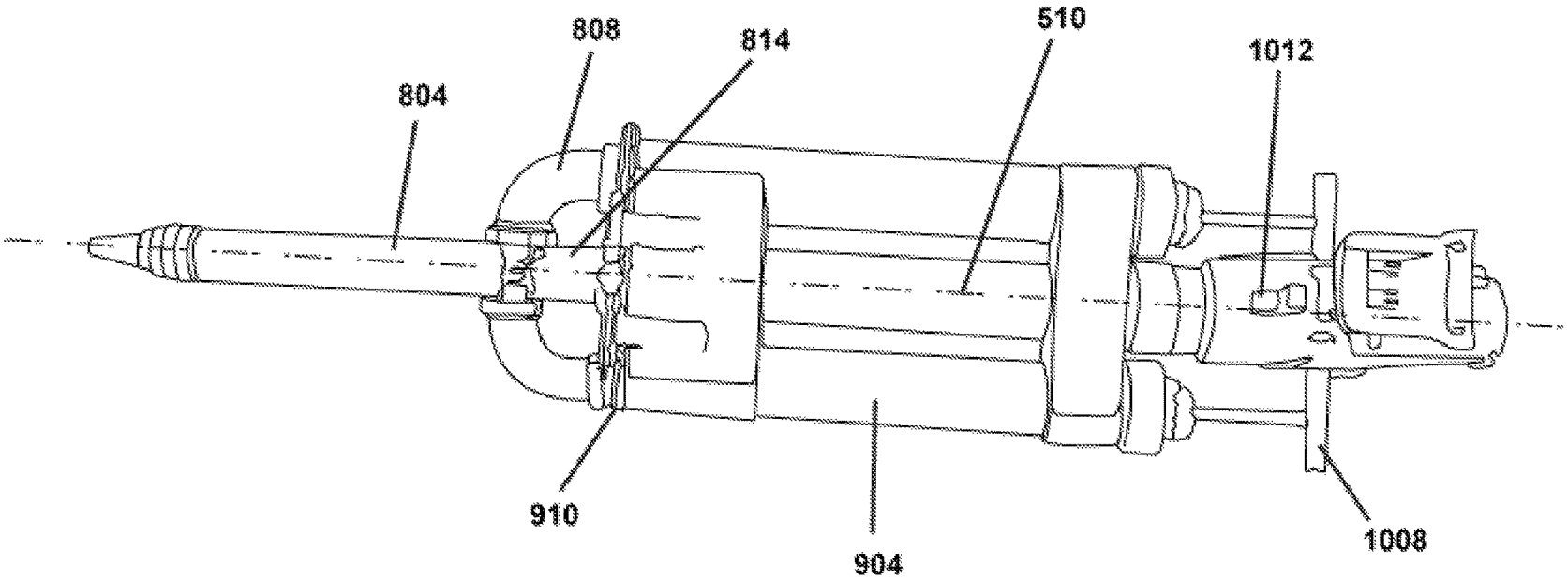
FIG. 16 is a multiple-tube caulking-gun bottom view.

FIG. 16 shows a multiple-tube caulking-gun bottom view. The relative position and purpose of the numerated mechanical elements are the same as defined above.

Figure 17:
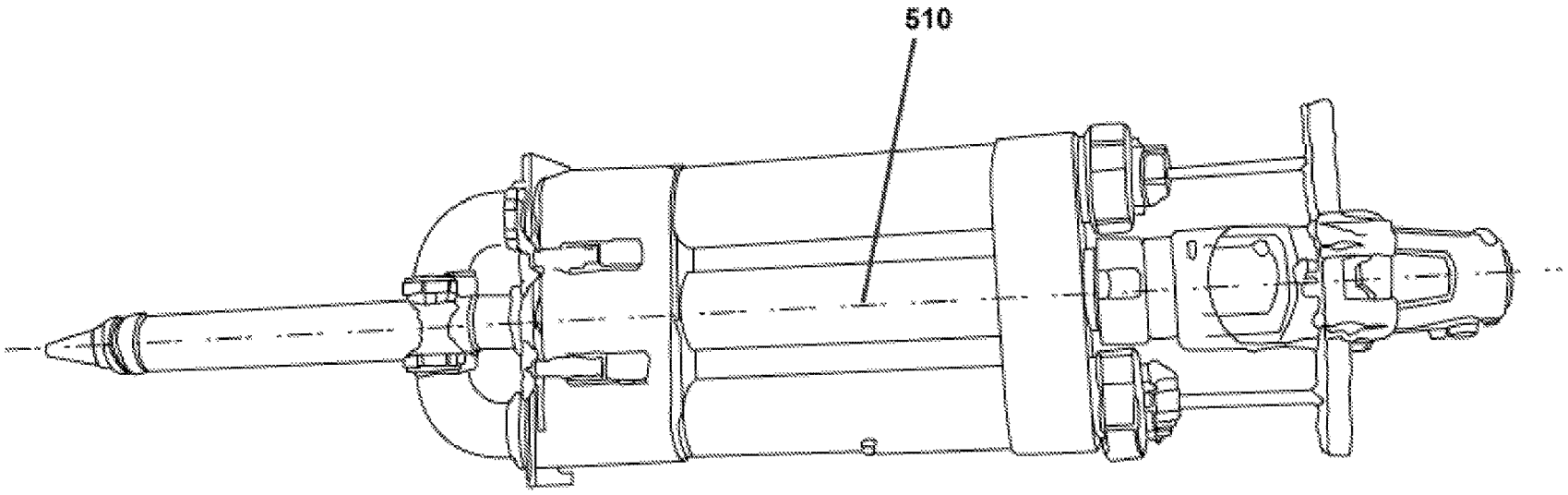
FIG. 17 is a multiple-tube caulking-gun top view.

FIG. 17 shows a multiple-tube caulking-gun top view. The relative position and purpose of the numerated mechanical elements are the same as defined above.

Figure 18:
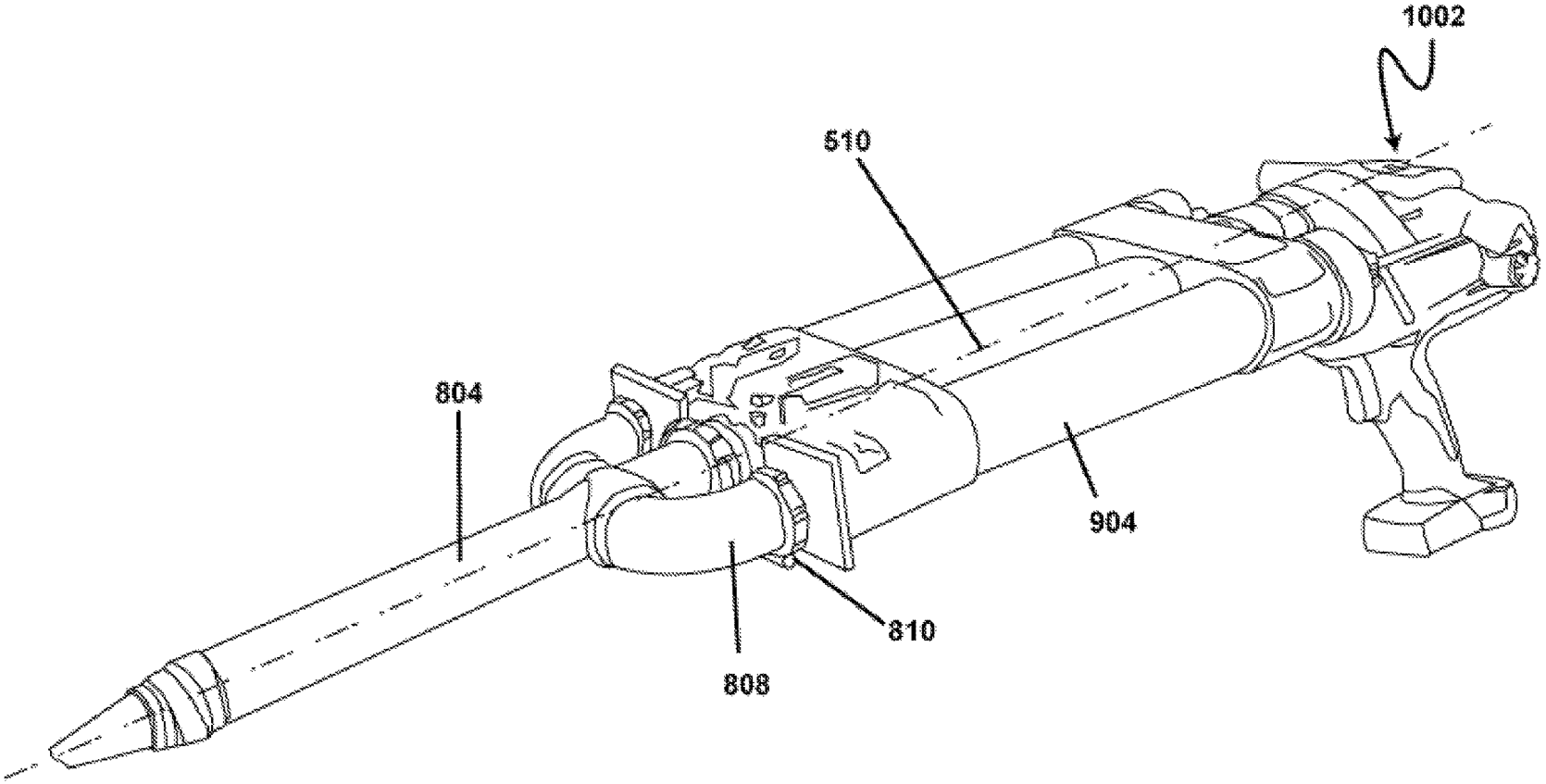
FIG. 18 is a multiple-tube caulking-gun side perspective view.

FIG. 18 shows a multiple-tube caulking-gun side perspective view.

Figure 19:
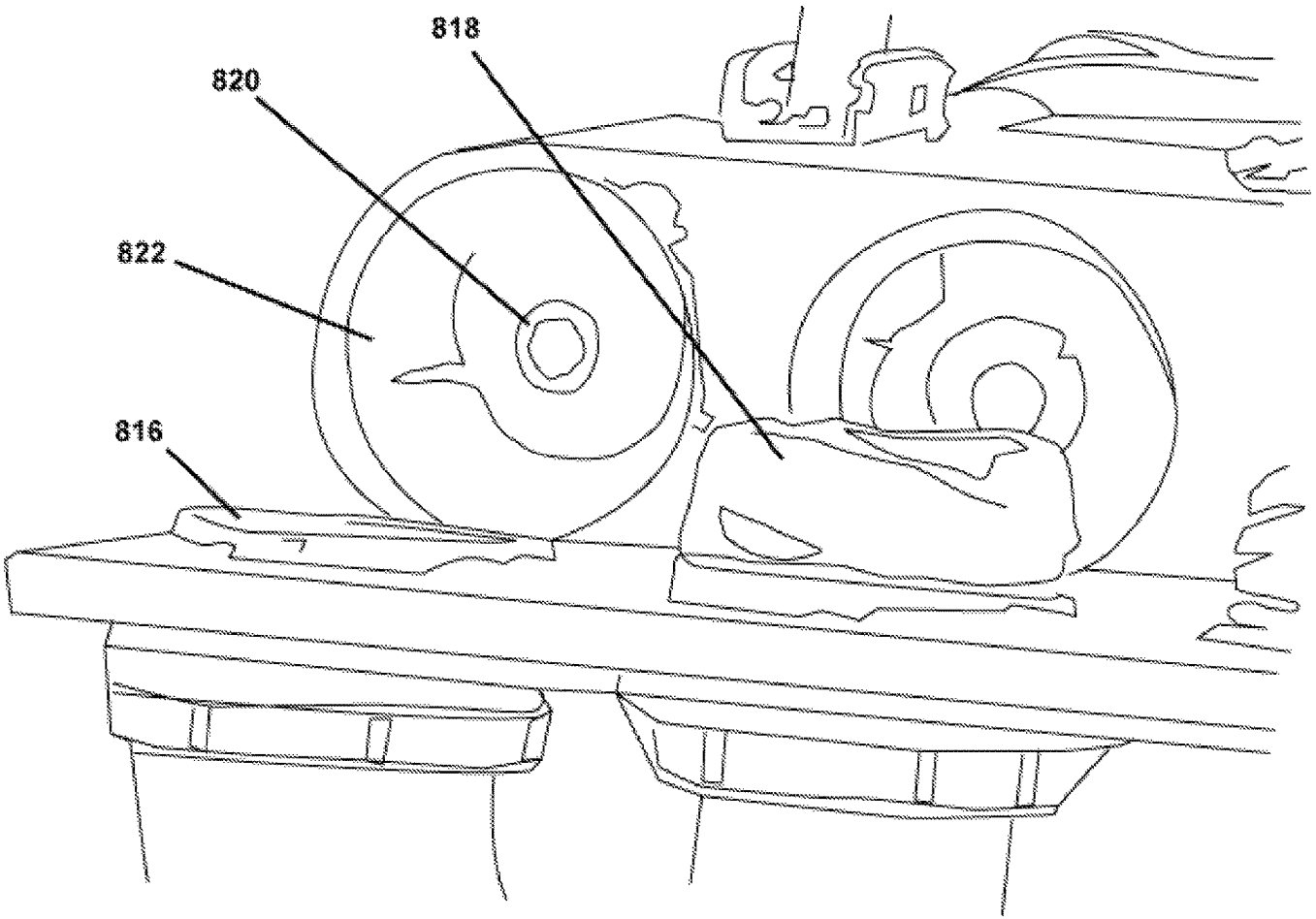
FIG. 19 is a multiple-tube caulking-gun close-up view.

FIG. 19 shows a multiple-tube caulking-gun enlarged view. Shown is an enlarged view of a hingedly opened multiple-tube caulking-gun, wherein the caulk exit-port component 802 is hingedly separated from multiple-tube barrel component 902. Exit port 816 from transition-flow first curved tube 808 is shown. Leftover-compressed-caulking-sausage skin 818 is shown as the result of being completely emptied during previous use. Central port portion 820 and perimeter port portion 822 of tube 904 are also shown.

Figure 20:
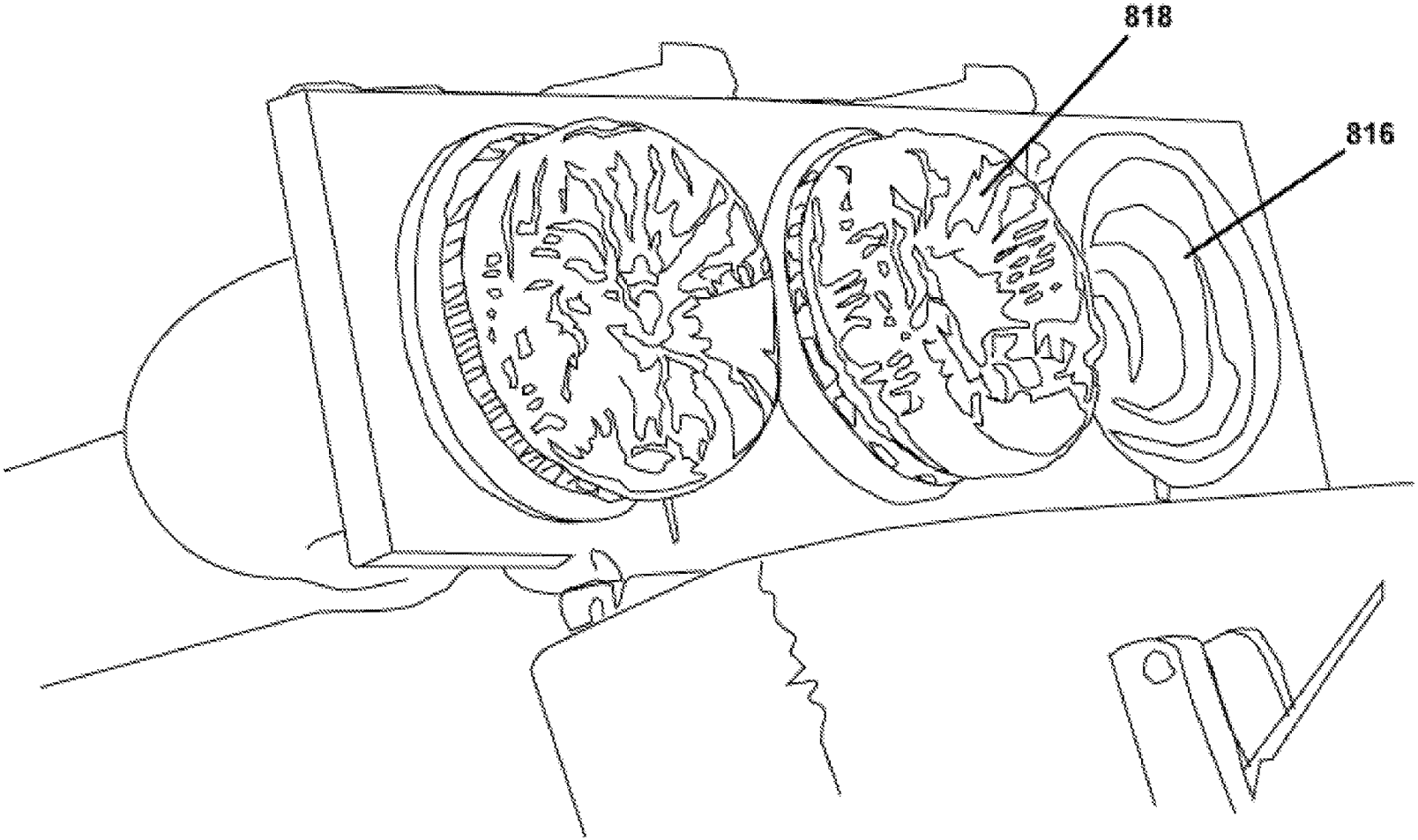
FIG. 20 is a multiple-tube caulking-gun enlarged view.

FIG. 20 shows a multiple-tube caulking-gun enlarged view. Shown is an enlarged view of a hingedly opened multiple-tube caulking-gun, wherein the caulk exit-port component 802 is hingedly separated from multiple-tube barrel component 902. The relative position and purpose of the numerated mechanical elements are the same as defined above.

Figure 21:
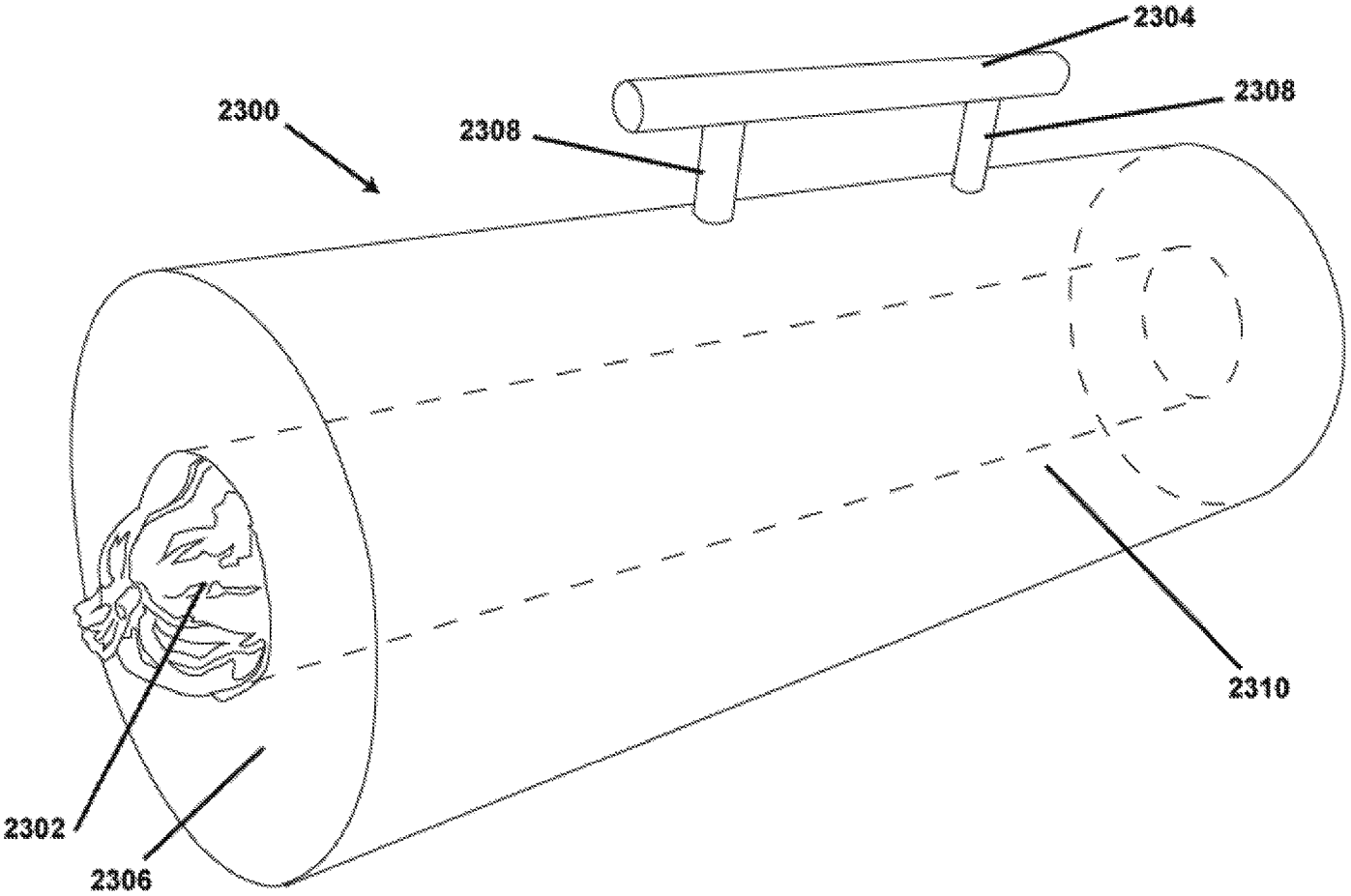
FIG. 21 is a caulking-cannon cartridge side-perspective view.

FIG. 21 shows a caulking-cannon caulk-cartridge embodiment side-perspective view. Shown is a caulk-cartridge embodiment that is a sausage-barrel assembly. Using phantom lines, caulk sausage 2302 is shown as being positioned within a hollow and cylindrical volume running the entire longitudinal length of caulking cartridge 2300. Caulking cartridge 2300 has cylindrical sidewall 2310, removable end wall 2306, handle arms 2308, and handle 2304.

Although the invention has been shown and described with respect to certain embodiments, it is obvious that equivalent alterations and modifications will occur to others skilled in the art upon the reading and understanding of this specification. Additionally, while a particular feature of the invention may have been disclosed with respect to only one of several embodiments, such feature may be combined with one or more other features of the other embodiments as may be desired and advantageous for any given or particular application.

What is claimed is:

1. A caulking cannon comprising:

a motorized plunger-moving component configured to drive a plunger shaft along an axis that is substantially parallel to a caulking-cannon longitudinal axis;

wherein a plunger handle is attached to an outer end of the plunger shaft;

a cartridge-holding barrel component coupled to the motorized plunger-moving component;

the cartridge-holding barrel component having a rear wall and a front wall protruding outward from the cartridge-holding barrel component and defining a longitudinal length of the cartridge-holding barrel component and a longitudinal length of a caulk cartridge being inserted into the cartridge-holding barrel component;

a caulk exit-port component coupled to the cartridge-holding barrel component;

wherein the plunger shaft is configured to move in a first direction parallel to the caulking-cannon longitudinal axis and thereby enter into a volume of space within the cartridge-holding barrel component;

wherein the cartridge-holding barrel component is configured to hold the caulk cartridge having a fluid-chamber volume of at least three-fourths (¾) of a gallon;

wherein the motorized plunger-moving component has a first hand grip and is turned off and on by using a trigger on the first hand grip;

wherein the caulk exit-port component is configured to channel caulk fluid flow from the caulk cartridge to an exit orifice;

a handle coupled to the cartridge-holding barrel component providing a user with a second hand grip for holding the caulking cannon;

wherein the handle is oriented towards the rear wall at an angle ranging from about 30 to about 90 degrees relative to the caulking-cannon longitudinal axis;

wherein the handle has a load capacity of at least 15 pounds.

2. The caulking cannon according to claim 1, wherein the cartridge-holding barrel component is removably coupled to the motorized plunger-moving component.

3. The caulking cannon according to claim 1, wherein the handle has a load capacity of at least 20 pounds.

4. The caulking cannon according to claim 1, wherein the handle has a load capacity of at least 25 pounds.

5. The caulking cannon according to claim 1, wherein the caulk cartridge is an enclosed volume that is substantially cylindrical and has at least one removable end.

6. The caulking cannon according to claim 1, wherein the caulk cartridge is a bucket with orifices at a top and bottom of the bucket.

7. The caulking cannon according to claim 1, wherein the caulk cartridge is a sausage barrel assembly.

8. The caulking cannon according to claim 1, wherein a longitudinal length of the caulking cannon, not including a length of the plunger shaft, is at least 42 inches.

9. The caulking cannon according to claim 1, wherein a longitudinal length of the caulking cannon, not including a length of the plunger shaft, ranges from 42 inches to 60 inches.

* * * * *